United States Patent [19]

Tanji et al.

[11] Patent Number: 5,024,932

[45] Date of Patent: Jun. 18, 1991

[54] LIGHT-SENSITIVE SILVER HALIDE PHOTOGRAPHIC MATERIAL

[75] Inventors: Masaki Tanji; Toyoki Nishijima, both of Odawara, Japan

[73] Assignee: Konica Corporation, Tokyo, Japan

[21] Appl. No.: 489,748

[22] Filed: Feb. 26, 1990

Related U.S. Application Data

[63] Continuation of Ser. No. 259,535, Oct. 18, 1988, abandoned.

[30] Foreign Application Priority Data

Nov. 6, 1987 [JP] Japan ..... 62-281822

[51] Int. Cl.[5] ..... G03C 1/02; G03C 1/30

[52] U.S. Cl. ..... 430/567; 430/569; 430/539; 430/626; 430/642

[58] Field of Search ..... 430/567, 569, 642, 539, 430/626

[56] References Cited

U.S. PATENT DOCUMENTS

| | | | |
|---|---|---|---|
| 4,564,591 | 1/1986 | Tanaka et al. | 430/567 |
| 4,621,041 | 11/1986 | Saikawa et al. | 430/569 |
| 4,640,890 | 3/1987 | Fujita et al. | 430/567 |
| 4,661,441 | 4/1987 | Kajiwara et al. | 438/555 |
| 4,917,994 | 4/1990 | Martinez et al. | 430/642 |

*Primary Examiner*—Hoa Van Le
*Assistant Examiner*—Thorl Chen
*Attorney, Agent, or Firm*—Jordan B. Bierman

[57] ABSTRACT

A light-sensitive silver halide photographic material having a support and, provided thereon, photographic component layers including at least one light-sensitive silver halide emulsion layer containing silver halide grains having a silver chloride content of not less tha 90 mole % and having been subjected to gold sensitization, said photographic component layer containing a gelatin of which isoelectric point being 4.0 to 5.0 and the film pH of said photographic component layer being not more than 6.0.

13 Claims, No Drawings

LIGHT-SENSITIVE SILVER HALIDE PHOTOGRAPHIC MATERIAL

This application is a continuation of application Ser. No. 259,535, filed Oct. 18, 1988 now abandoned.

FIELD OF THE INVENTION

The present invention relates to a light-sensitive silver halide photographic material, and, more particularly, to a light-sensitive silver halide photographic material suited to rapid processing.

BACKGROUND OF THE INVENTION

In recent years, what has been sought in light-sensitive silver halide photographic materials is that they can perform rapid processing, can have high image quality and yet superior processing stability, and can be of low cost. Particularly sought after are light-sensitive silver halide photographic materials that can be processed rapidly.

Light-sensitive silver halide photographic materials are usually continuously processed by an automatic processing machine, installed in all photofinishing laboratories. However, as an improvement in service to users, it is desirable to finish processing and to return the products to users on the day the development orders were received, and, nowadays, it is further desired even to return products within a few hours after the receipt of an order, whereby there is an increasing necessity for rapid processing. Development of rapid processing has also been hastened because a shortened processing time may bring about an increase in production efficiency and a cost decrease may thereby be made possible.

To achieve rapid processing, approaches have been made from two directions, i.e., the light-sensitive material and the processing solution. In respect of color developing processing, it has been attempted to raise the temperature, the pH and the concentration of a color developing agent, and also it is known to add additives such as development accelerators. The above development accelerators may include 1-phenyl-4-pyrazolidone, as disclosed in British Patent No. 811,185, N-methyl-p-aminophenol, as disclosed in U.S. Pat. No. 2,417,514, and N,N,N',N'-tetramethyl-p-phenylenediamine, as disclosed in Japanese Patent Publication Open to Public Inspection (hereinafter referred to as Japanese Patent O.P.I. Publication) No. 15554/1975. The method in which these are used, however, cannot achieve sufficient rapidness, and may be often accompanied by a deterioration of performance such as an increase in fog.

On the other hand, the shape, size and composition of silver halide grains of a silver halide emulsion used in the light-sensitive material are known to greatly affect the development speed and so forth. In particular, it is known that the halogen composition may greatly affect the same, and that a very remarkably high development speed can be shown when a silver chloride-rich silver halide is used.

However, the silver chloride-rich silver halide is poor in long-term storage stability, and seriously susceptible to fog, particularly when stored under conditions of high temperature and high humidity. It also has a much lower speed compared with silver bromide-rich silver chlorobromide, silver bromide or silver iodobromide. To increase the speed of the silver chloride-rich silver halide, gold sensitization is most suitable (as well as sulfur sensitization), which, however, brings about an increase in fog as a property inherent in gold compounds, and also soft gradation at the toe of the characteristic curve. Increasing the amount of gold compounds may bring about suppression of the fog, but on the other hand may result in greater soft gradation, additionally accompanied by desensitization.

Another possibility known as a means for improving the fog in storage stability of raw stocks, is to use cyanuric acid (Japanese Patent O.P.I. Publication No. 201335/1985), but this is disadvantageous in that although the fog can be suppressed the desensitization becomes greater.

Therefore, the development of a light-sensitive silver halide photographic material having high speed, high gradient and low fog, and also being superior in stability and yet suited for rapid processing, is energetically sought.

SUMMARY OF THE INVENTION

The present invention has been made in view of the foregoing circumstances, and an objective thereof is to provide a light-sensitive silver halide photographic material having high speed, high gradient and low fog, and also being superior in stability and yet suited to rapid processing.

The above objective of the present invention can be achieved by a light-sensitive silver halide photographic material comprising a support and provided thereon a photographic component layer comprising at least one silver halide emulsion layer, wherein at least one of said silver halide emulsion layer contains silver halide grains having a silver chloride content of not less than 90 mol % and having been subjected to gold sensitization, said photographic component layer contains gelatin having an isoelectric point of from 4.0 to 5.0, and said photographic component layer comprises a film pH of not more than 6.0.

DETAILED DESCRIPTION OF THE INVENTION

The present invention will be described below in greater detail.

The silver halide grains of the present invention have a silver chloride content of 90 mole % or more, and may preferably have a silver bromide content of 10 mole % or less, and a silver iodide content of 0.5 mole % or less. More preferably, the grains may comprise silver chlorobromide having a silver bromide content of 0.1 to 2 mole %.

The silver halide grains may be used alone or mixed with other silver halide grains having different compositions. They may be also used mixed with silver halide grains having a silver chloride content of 90 mole % or less.

In the silver halide emulsion layer containing the silver halide grains of the present invention, having a silver chloride content of 90 mole % or more, the silver halide grains having a silver chloride content of 90 mole % or more may be held in the whole silver halide grains contained in said emulsion layer, in the proportion of 60% by weight or more, preferably 80% by weight or more.

The composition of the silver halide grains of the present invention may be homogeneous throughout a grain, or may be different between the inside and outside of a grain. In the case in which the composition is different between the inside and outside of a grain, the composition may vary continuously or discontinuously.

There are no particular limitations on the grain size of the silver halide grains of the present invention, but, in view of other photographic performances such as sensitivity and adaptability to rapid processing, they may preferably range between 0.2 and 1.6 μm, and more preferably 0.25 1.2 μm. The above grain size can be measured according to various methods generally used in the present technical field. A typical method is disclosed in Loveland, "Grain Size Analytical Method" (A. S. T. M. Symposium on Light Microscopy, pp. 94–122, 1955) or "The Theory of The Photographic Process" (by Mees and James, Third Edition, published by Macmillan Publishing Co., Inc., see Second Paragraph).

This grain size can be measured by use of a projection area or diametric approximate value of a grain. In a case in which the grains are substantially of uniform shape, the grain size distribution can be reasonably precisely expressed as the diameter, or the projection area.

The grain size distribution of the silver halide grains of the present invention may be either polydisperse or monodisperse. The silver halide grains may preferably monodisperse silver halide grains having the variation coefficient in the grain size distribution of the silver halide grains, of 0.22 or less, and more preferably 0.15 or less.

The silver halide grains used in the emulsion of the present invention may be obtained by either an acidic method, a neutral method or an ammoniacal method. The grains may be allowed to grow at one time, or grow after seed grains have been formed. The manner of preparing the seed grains and the manner of growing them may be the same or different.

The manner of reacting a soluble silver salt with a soluble halogen salt may be either a regular mixing method, a reverse mixing method or a simultaneous mixing method, or a combination of any of these, but grains formed by the simultaneous mixing method are preferred. A further type of the simultaneous mixing method, which can be used, is the pAg-controlled double jet method, disclosed in Japanese Patent O.P.I. Publication No. 48521/1979.

If necessary, there may be further used a silver halide solvent such as thioether. Compounds such as mercapto group-containing compounds, nitrogen-containing heterocyclic compounds or sensitizing dyes may be also used by adding them at the time when the silver halide grains are formed or after completion of the formation of grains.

The silver halide grains according to the present invention that can be used may have any shape. A preferable example is a cube having {100} faces as a crystal surface. Also, grains having the shape of octahedrons, tetradecahedrons, dodecahedrons, etc. may be used. There may be further used grains having a twin crystal face.

The silver halide grains according to the present invention that can be used may be grains comprising a single shape, or may be a mixture of grains having various shapes.

In the course of formation and/or growth of the silver halide grains used in the emulsion of the present invention, metal ions may be added to the grains by the use of at least one of a cadmium salt, a zinc salt, a lead salt, a thallium salt, an iridium salt or a complex salt thereof, a rhodium salt or a complex salt thereof, and an iron salt or a complex salt thereof, to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The emulsion containing the silver halide grains of the present invention (hereinafter "the emulsion of the present invention") may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the emulsion of the present invention may be grains wherein a latent image is mainly formed on the surface, or grains wherein it is formed mainly in the inside of a grain.

The silver halide grains according to the present invention are sensitized by using a gold compound. The gold compound of preference in the present invention may be of any gold having the oxidation valence number +1 or +3, and various gold compounds may be used. Typical examples thereof may include chloroaurate, potassium chloroaurate, auric trichloride, potassium auric thiocyanate, potassium iodoaurate, tetracyanoauric azide, ammonium aurothiocyanate, pyridyl trichlorogold, gold sulfide and gold selenide.

The gold compound may be added in an amount that may vary depending on various conditions, but, as a standard, in an amount of from $10^{-8}$ mol to $10^{-1}$ mol, preferably from $10^{-7}$ mol to $10^{-2}$ mole, per mol of silver halide.

In the emulsion of the present invention, usable in combination are reduction sensitization using a reducing substance, noble metal sensitization using a noble metal compound, etc.

In the present invention, a chalcogen sensitizer may preferably be used in combination with the gold compound. The chalgogen sensitizer is a general term for a sulfur sensitizer, a selenium sensitizer and a tellurium sensitizer. For photographic use, preferred are the sulfur sensitizer and the selenium sensitizer. The sulfur sensitizer may include, for example, thiosulfate, allythiocarbazide, thiourea, allylisothiocyanate, cystine, p-toluene thiosulfonate and rhodanine. Besides these, there can be also used the sulfur sensitizers disclosed in U.S. Pat. Nos. 1,574,944, 2,410,689, 2,278,947, 2,728,668, 3,501,313 and 3,656,955, German Laid-open Application (OLS) No. 14 22 869, Japanese Patent O.P.I. Publications No. 24937/1981 and No. 45016/1980, etc. The sulfur sensitizer may be added in an amount that may vary in a considerable range depending on the various conditions such as pH, temperature, size of silver halide grains, but, as a standard, preferably in an amount of from $10^{-7}$ mol to $10^{-1}$ mol per mol of silver halide.

In the present invention, the isoelectric point indicates the isoelectric point of gelatin to which any hardening treatment has not been applied yet.

Herein, the isoelectric point is expressed in terms of the hydrogen ion concentration of a solution available when the potential of electrical double layers of ampholytes or colloidal particles registers zero, and can be measured according to "Photographic Gelatin Test Method (or the PAGI method)". More specifically, it can be found by measuring the pH after an aqueous 1% gelatin solution has been passed through a cation and anion exchange resins mixed-bed column.

The gelatin used in the present invention, having an isoelectric point of from 4.0 to 5.0 can be appropriately selected from among those available as photographic gelatins.

The photographic component layer in which the gelatin has an isoelectric point of from 4.0 to 5.0 essentially includes the silver halide emulsion layer containing silver halide grains having a silver chloride content of not less than 90 mol %, but the gelatin may further preferably be contained in other silver halide emulsion layers and non-light-sensitive layers.

The film pH in the present invention, of the photographic layer of the light-sensitive silver halide photographic material, refers to the pH of a photographic layer obtained by coating a coating solution used for preparing a light-sensitive photographic material, and not necessarily the same as the pH of the coating solution. That film pH can be measured in the following manner:

(1) Pure water in an amount of 0.05 ml is dropped on the surface of a photographic layer.

(2) After being left for 3 minutes, the film pH is measured by use of a film pH measuring electrode (GS-165F; available from Toa Denpa Co.).

It is common in conventional light-sensitive silver halide photographic materials that the film pH measured in the above manner is in a range exceeding 6.0 and not exceeding 7.0. This is because a film pH of 6.0 or less may result in hindrance to hardening, or cause undesirable problems in which speed is lowered, and a pH value exceeding 7.0 tends to cause the problems wherein fog is generated.

The film pH can also be adjusted by using, as occasion demands, an acid as exemplified by sulfuric acid and citric acid or an alkali as exemplified by sodium hydroxide and potassium hydroxide In the present invention, to harden the silver halide emulsion layer, it is preferable to use a hardening agent of a chlorotriazine type, represented by Formula (HDA) or (HDB) shown below.

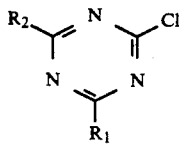

Formula (HDA)

In the formula, $R_1$ and $R_2$ each represent a chlorine atom, a hydroxyl group, an alkyl group, an alkoxy group, an —OM group (wherein M is a monovalent metal atom), an —$NR_3R_4$ group (wherein $R_3$ and $R_4$ each represent a hydrogen atom, an alkyl group or an aryl group), or an —$NHCOR_5$ group (wherein $R_5$ represents a hydrogen atom, an alkyl group, an aryl group or an alkylthio group), excluding the case wherein $R_1$ and $R_2$ are both chlorine atoms at the same time.

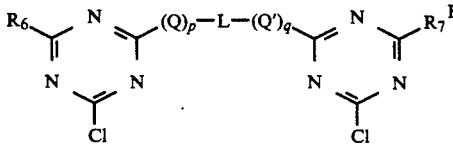

Formula (HDB)

In the formula, $R_6$ and $R_7$ each represent a chlorine atom, a hydroxyl group, an alkyl group, an alkoxy group or an —OM group (wherein M is a monovalent metal atom). Q and Q' each represent a linking group showing —O—, —S— or —NH—; L represents an alkylene group or an arylene group; and p and q each represent 0 or 1.

Typical examples of the preferred hardening agents represented respectively by the above Formulas (HDA) and (HDB) are described below.

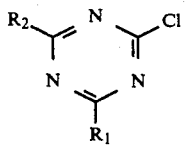

Formula (HDA)

| Compound No. | $R_1$ | $R_2$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —$NHCOCH_3$ |
| HD-9 | —OH | —$NHC_2H_5$ |

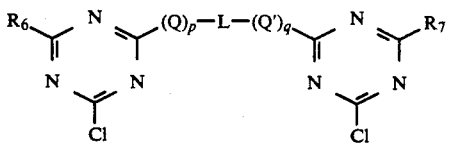

Formula (HDB)

| Compound No. | $R_6$ | $R_7$ | Q | p | Q' | q | L |
|---|---|---|---|---|---|---|---|
| HD-10 | —Cl | —Cl | O | 1 | O | 1 | 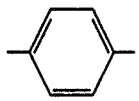 |
| HD-11 | —ONa | —ONa | —O— | 1 | —O— | 1 | —$CH_2CH_2$— |
| HD-12 | —ONa | —ONa | — | 0 | — | 0 | —$CH_2CH_2$— |
| HD-13 | —$OCH_3$ | —$OCH_3$ | S | 1 | —S— | 1 | —$CH_2CH_2$— |
| HD-14 | —ONa | —ONa | —NH— | 1 | —NH— | 1 | —$CH_2CH_2$— |
| HD-15 | —ONa | —ONa | —NH— | 1 | —O— | 1 | —$CH_2CH_2$— |

To add the hardening agent to the photographic component layers, it may be dissolved in water or a water-miscible solvent as exemplified by methanol and ethanol, and then the solution may be added to coating solutions for the photographic component layers. The addition may be carried out according to any of the batch system and the in-line system. There are no particular limitations on the time of the addition, but it may be preferably added immediately before coating.

These hardening agents are added in an amount of from 0.5 to 100 mg, preferably from 2.0 to 50 mg, per 1 g of gelatin.

Also usable in combination so long as the effect of the present invention may not be impaired are other hardening agents as exemplified by compounds of an aldehyde type, an aziridine type, an isoxazole type, an epoxy type, a vinylsulfone type, an acryloyl type, a carbodiimide type, a maleimide type, an acetylene type, a methane sulfonate type and an N-methylol type.

The emulsion of the present invention can be spectrally sensitized to a desired wavelength region with use of a sensitizing dye. The sensitizing dye may be used alone, but may be used in combination of two or more ones. Together with the sensitizing dye, the emulsion may contain a supersensitizing agent which is a dye having itself no action of spectral sensitization or a compound substantially absorbing no visible light, and that can strengthen the sensitizing action of the sensitizing dye.

In addition to the purpose of utilizing their inherent action of spectral sensitization, these sensitizing dyes can be also used for the purposes such as adjustment of gradation and adjustment of development.

Usable sensitizing dyes include cyanine dyes, merocyanine dyes, composite cyanine dyes, composite merocyanine dyes, holopolar cyanine dyes, hemicyanine dyes, styryl dyes and hemioxanol dyes.

In the silver halide emulsion of the present invention, an antifoggant or a stabilizer can be added during chemical ripening, at the time of completion of the chemical ripening and/or after completion of the chemical ripening and before the time of coating a silver halide emulsion layer, for the purpose of preventing fog in the course of preparation of light-sensitive materials, during storage or during photographic processing, or keeping stable the photographic performances.

As a binder used in the light-sensitive silver halide photographic material of the present invention, it is advantageous to use gelatin, but it is also possible to use hydrophilic colloids such as gelatin derivatives, graft polymers of gelatin with other macromolecules, proteins, sugar derivatives, cellulose derivatives and synthetic hydrophilic high molecular substances such as homopolymer or copolymer.

Dye-forming couplers used in the present invention may contain a compound capable of releasing a photographically useful fragment, such as a development accelerator, a bleach accelerator, a developing agent, a silver halide solvent, a color toning agent, a hardening agent, a fogging agent, an antifoggant, a chemical sensitizer, a spectral sensitizer and a desensitizer, through the coupling with an oxidized product of a developing agent. These dye-forming couplers may be used in combination with colored couplers and DIR couplers. DIR compounds may also be used in place of the DIR couplers.

The DIR couplers and DIR compounds that can be used include those in which a restrainer has been directly bonded to the coupling position, timing DIR couplers, and timing DIR compounds. As to the restrainer, those diffusible by elimination and those not so much diffusible can be used alone or in combination depending on purpose. Non-coloring couplers can also be used in combination with the dye-forming couplers.

Preferably usable as yellow dye forming couplers are acylacetanilide couplers. Among these, advantageous are benzoylacetanilide compounds and pivaloylacetanilide compounds.

Preferably usable as magenta dye forming couplers are 5-pyrazolone couplers, pyrazolobenzimidazole couplers, pyrazoloazole couplers and open-chain acylacetonitrile couplers.

Preferably usable as cyan dye forming couplers are naphthol couplers and phenol couplers.

In addition to the above compounds, various photographic additives can be added in the light-sensitive silver halide photographic material containing the silver halide emulsion of the present invention.

For example, they include ultraviolet absorbents, development accelerators, surface active agents, water-soluble irradiation preventive dyes, film property improvers, color-contamination preventive agents, dye image stabilizers, water-soluble or oil-soluble brightening agents, and background-color regulators.

Among the dye-forming couplers, colored couplers, DIR couplers, DIR compounds, image stabilizers, anti-color-fogging agents, ultraviolet absorbents and brightening agents, hydrophobic compounds can be added by use of a variety of methods such as a solid dispersion method, a latex dispersion method and and an oil-in-water emulsification dispersion method. This can be suitably selected depending on the chemical structure of the hydrophobic compounds such as couplers. As the oil-in-water emulsification dispersion method, a conventionally known method for dispersing hydrophobic additives such as couplers can be applied. Usually, the method may be carried out by dissolving the couplers in a high-boiling organic solvent having a boiling point of 150° C. or more optionally together with a low-boiling and/or water soluble organic solvent, and carrying out emulsification dispersion in a hydrophilic binder such as an aqueous gelatin solution by use of a surface active agent and by use of a dispersing means such as a stirrer, a homogenizer, a colloid mill, a flow jet mixer, an ultrasonic device, followed by adding the dispersion to an intended hydrophilic colloid layer. There may be inserted a step of removing the dispersing solution or, at the same time of the dispersion, the low boiling organic solvent.

The proportion of the high-boiling organic solvent to the low-boiling organic solvent may preferably range from 1:0.1 to 1:50, more preferably from 1:1 to 1:20.

The high boiling organic solvent to be used may include organic solvents having a boiling point of 150° C. or more such as phenol derivatives, alkyl phthalates, phosphates, citrates, benzoates, alkyl amides, aliphatic acid esters and trimesic acid esters which do not react with an oxidized product of a developing agent.

The light-sensitive photographic material of the present invention can form an image by carrying out development processing known in the present industrial field.

The color developing agent used in a color developing solution in the present invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2-hydroxytoluene, 2-amino-3-hydroxy toluene and 2-hydroxy-3-amino-1,4-dimethyl-benzene.

Particularly useful primary aromatic amine type color developing agent includes N,N-dialkyl-p-phenylenediamine compounds, wherein the alkyl group and the phenyl group may be substituted with any substituent. Of these, examples of particularly useful compounds may include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, and 4-amino-N-(2-methoxyethyl)-N-ethyl-3-methylaniline-p-toluene sulfonate.

In addition to the above primary aromatic amine type color developing agent, the color developing solution used in the processing of the light-sensitive silver halide photographic material according to the present invention may also contain known compounds for developing solution components. For example, there may be optionally contained alkali agents such as sodium hydroxide, sodium carbonate and potassium carbonate, alkali metal sulfites, alkali metal bisulfites, alkali metal thiocyanates, alkali metal halides, benzyl alcohol, water softening agents and thickening agents.

The light-sensitive photographic material of the present invention may preferably be developed using a color developing solution that contains no water-soluble bromide at all or alternatively contains it in a very small amount. If an excess water-soluble bromide is contained, it may sometimes occur that the developing speed of the light-sensitive photographic material is abruptly lowered. Bromide ion concentration in the color developing solution may be about 0.1 g or less, preferably 0.05 g or less, in terms of potassium bromide and per liter of the color developing solution.

The effect of the present invention becomes particularly remarkable when a water-soluble chloride is used as a development regulator in the above color developing solution. The water-soluble chloride to be used may be used in the range of from 0.5 g to 5 g, preferably from 1 g to 3 g, in terms of potassium chloride and per liter of the color developing solution.

The color developing solution may have usually the pH of 7 or more, most usually about 10 to about 13.

The color development temperature may be usually 15° C. or more, and generally in the range of from 20° C. to 50° C. For the rapid processing, the developing may be preferably carried out at 30° C. or more. The color development time may be preferably in the range of 20 seconds to 60 seconds, more preferably in the range of 30 seconds to 50 seconds.

The light-sensitive silver halide photographic material according to the present invention may contain the above color developing agent in hydrophilic colloid layers as a color developing agent itself or as a precursor thereof, and may be processed by use of an alkaline activated bath. The precursor of color developing agent is a compound capable of forming a color developing agent under the alkaline condition, and may include precursors of the type of a Schiff base with an aromatic aldehyde derivative, polyvalent metallic ion complex precursors, phthalic acid imide derivative precursors, phosphoric acid amide derivative precursors, sugar amine reaction product precursors, and urethane type precursors. These precursors of the aromatic primary amine color developing agents are disclosed, for example, in U.S. Pat. No. 3,342,599, U.S. Pat. No. 2,507,114, U.S. Pat. No. 2,695,234 and U.S. Pat. No. 3,719,492, British Patent No. 803,783, Japanese Patent O.P.I. Publications No. 185628/1978 and No. 79035/1979, and Research Disclosures No. 15159, No. 12146 and No. 13924.

These aromatic primary amine color developing agents or the precursors thereof are required to be added in such an amount that a sufficient color development can be achieved only with the amount. This amount may considerably range depending on the type of light-sensitive materials, but, approximately, they may be used in the range of 0.1 mole to 5 moles, preferably 0.5 mole to 3 moles, per mole of silver halide. These color developing agents or the precursors thereof may be used alone or in combination. In order to incorporate them into a light-sensitive material, they can be added by dissolving them in a suitable solvent such as water, methanol, ethanol and acetone, can be added as an emulsification dispersion formed by using a high boiling organic solvent such as dibutyl phthalate, dioctyl phthalate and tricrezyl phosphate, or can be added by impregnating a latex polymer with them as disclosed in Research Disclosure No. 14850.

The light-sensitive silver halide photographic material of the present invention is subjected to bleaching and fixing after color developing. The bleaching may be carried out at the same time with the fixing. As a bleaching agent, there may be used various compounds, among which compounds of polyvalent metals such as iron (III), cobalt (III) and copper (II), particularly, complex salts of cations of these polyvalent metals with organic acids, for example, metal complex salts of aminopolycarboxylic acid such as ethylenediaminetetraacetic acid, nitrylotriacetic acid and N-hydroxyethyl ethylenediaminediacetic acid, malonic acid, tartaric acid, malic acid, diglycolic acid and dithioglycolic acid, or ferricyanates, bichromate, etc. may be used alone or in combination.

As a fixing agent, there may be used a soluble complexing agent capable of solubilizing a silver halide as a complex salt. This soluble complexing agent may include, for example, sodium thiosulfate, ammonium thiosulfate, potassium thiocyanate, thiourea and thioether.

After the fixing, washing with water is usually carried out. In place of the washing with water, stabilizing may be carried out, or both of them may be carried out in combination. A stabilizing solution used in the stabilizing may contain pH adjusters, chelating agents, anticeptic agents, etc. Specific conditions for these are available by making reference to Japanese Patent O.P.I. Publication No. 134636/1983, etc.

EXAMPLES

Specific examples of the present invention will be described below, but the working embodiments of the invention are by no means limited to these.

EXAMPLE 1

Following the procedures described in Japanese Patent O.P.I. Publication No. 45437/1984, an aqueous solution of silver nitrate and an aqueous halide solution comprising potassium bromide and sodium chloride were mixed with stirring in an aqueous solution of gelatin (isoelectric point: 5.0) under the conditions of 60° C. and pAg=7.8, thus preparing a monodisperse silver chlorobromide emulsion (EM-1) having a silver chloride content of 50 mol %. Observation using an electron microscope revealed that EM-1 comprised grains having an average grain size (calculated as a sphere) of 0.43 μm and the shape of a cube.

Next, prepared under the condition of pAg=7.3 were silver chlorobromide emulsions and a silver chloride emulsion having a silver chloride content of 95 mol % (EM-2), 99.5 mol % (EM-3) and 100 mol % (EM-4), respectively. Each emulsion comprised grains having the shape of a cube and the following average grain size: EM-2: 0.40 μm, EM-3: 0.38 μm, and EM-4: 0.37 μm.

Next, on each of EM-1 to EM-4, chemical ripening was carried out using chloroauric acid alone or chloroauric acid and sodium thiosulfate in combination as shown in Table 1, followed by application of spectral sensitization using the following red-sensitive sensitizing dye (P-1) to prepare each emulsion.

Subsequently, 10 g of cyan coupler (CC-1) and 10 g of cyan coupler (CC-2) were dissolved in a mixed solvent of 10 ml of a high-boiling organic solvent (DOP) with 30 ml of ethyl acetate, and the solution was added to an aqueous solution of gelatin (isoelectric point: 4.9) containing sodium dodecylbenzenesulfonate, to which the above emulsion EM-1 was added to prepare a coating solution for a red-sensitive emulsion layer. Following the same procedures, coating solutions for respective layers were prepared and coated in succession on a polyethylene resin coated paper from the support side so as to give the following constitution. This was designated as Sample 1.

| Layer | Constitution |
|---|---|
| Seventh layer | Gelatin (1.0 g/m$^2$) Hardening agent (HDC, 0.08 g/m$^2$) |
| Sixth layer | Ultraviolet absorbent (UV-1, 0.3 g/m$^2$) Gelatin (0.7 g/m$^2$) |
| Fifth layer | Red-sensitive silver chlorobromide emulsion |
| | (amount of coated silver: 0.25 g/m$^2$) |
| | Cyan coupler (CC-1, 0.2 g/m$^2$) |
| | Cyan coupler (CC-2, 0.2 g/m$^2$) |
| | High-boiling organic solvent (DOP, 0.2 g/m$^2$) Gelatin (1.0 g/m$^2$) |
| Fourth layer | Ultraviolet absorbent (UV-1, 0.7 g/m$^2$) Gelatin (1.3 g/m$^2$) |
| Third layer | Green-sensitive silver chlorobromide emulsion |
| | (amount of coated silver: 0.35 g/m$^2$) |
| | Magenta coupler (MC-1, 0.4 g/m$^2$) |
| | High-boiling organic solvent (DOP, 0.2 g/m$^2$) Gelatin (1.5 g/m$^2$) |
| Second layer | Gelatin (1.0 g/m$^2$) |
| First layer | Blue-sensitive silver chlorobromide emulsion |
| | (amount of coated silver: 0.4 g/m$^2$) |
| | Yellow coupler (YC-1, 0.8 g/m$^2$) |
| | High-boiling organic solvent (DOP, 0.03 g/m$^2$) Gelatin (2.0 g/m$^2$) |

Support: Polyethylene resin coated paper

DOP: Dioctyl phthalate

P-1

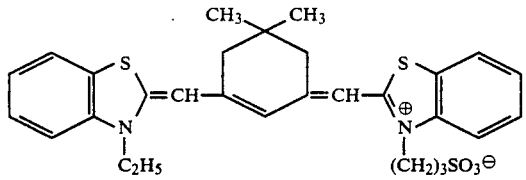

CC-1

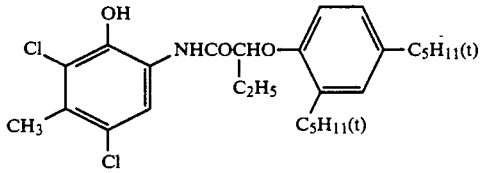

CC-2

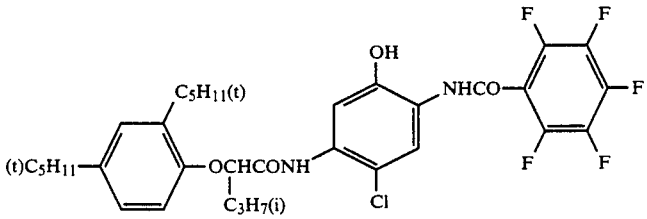

-continued

MC-1

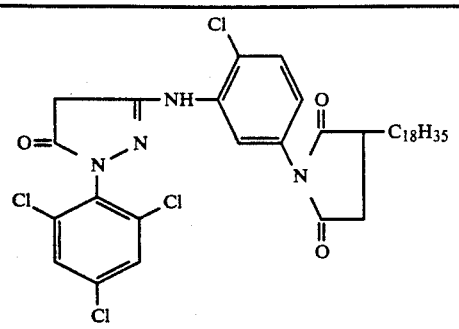

YC-1

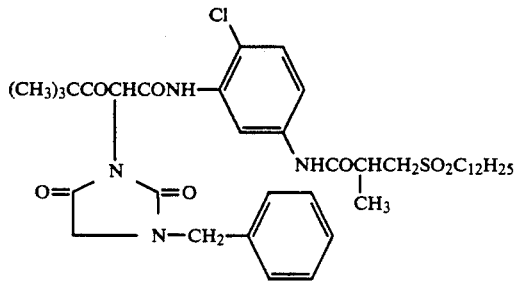

HDC

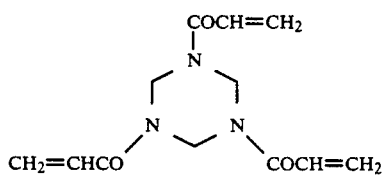

UV-1

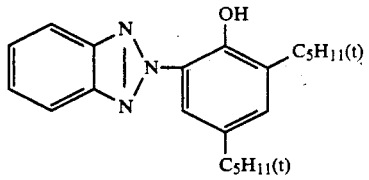

Next, Samples 2 to 10 were prepared following the same procedures as for Sample 1 except that the silver halide emulsions and hardening agent in Sample 1 were varied as shown in Table 1.

TABLE 1

| Sample No. | EM No. | Silver chloride content (mol %) | Amount (mol/molAgX) Chloro-auric acid | Sodium thio-sulfate | Film pH | Hardening agent |
|---|---|---|---|---|---|---|
| 1 (X) | EM-1 | 50 | $2.7 \times 10^{-6}$ | — | 6.4 | HDC |
| 2 (X) | " | 50 | " | — | 5.7 | HD-2 |
| 3 (X) | EM-2 | 95 | — | — | 6.4 | HDC |
| 4 (X) | " | 95 | $2.7 \times 10^{-6}$ | — | 6.4 | " |
| 5 (Y) | " | 95 | " | — | 5.7 | HD-2 |
| 6 (Y) | " | 95 | " | $3.5 \times 10^{-6}$ | 5.7 | " |
| 7 (Y) | EM-3 | 99.5 | " | — | 5.7 | " |
| 8 (Y) | " | 99.5 | " | $3.5 \times 10^{-6}$ | 5.7 | " |
| 9 (Y) | EM-4 | 100 | " | — | 5.7 | " |
| 10 (Y) | " | 100 | " | $3.5 \times 10^{-6}$ | 5.7 | " |

(X): Comparative Example
(Y): Present Invention

The light-sensitive materials thus obtained were subjected to white light wedge exposure with use of a KS-7 type sensitometer (manufactured by Konica Corporation), and thereafter the following processing was carried out.

[Processing steps]

| | Temp. | Time |
|---|---|---|
| Color developing | 35.0 ± 0.3° C. | 45 seconds |
| Bleach-fixing | 35.0 ± 0.3° C. | 45 seconds |
| Stabilizing | 30~34° C. | 90 seconds |
| Drying | 60~80° C. | 60 seconds |

[Color developing solution]

| | |
|---|---|
| Pure water | 800 ml |
| Triethanolamine | 10 g |
| N,N-diethylhydroxylamine | 5 g |
| Potassium bromide | 0.02 g |

-continued

| | |
|---|---|
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent (a 4,4'-diaminostilbene disulfonic acid derivative) | 1.0 g |
| Potassium carbonate | 27 g |
| Made up to 1 liter by adding water and adjusted to pH = 10.10 using potassium hydroxide or sulfuric acid. | |
| [Bleach-fixing solution] | |
| Ferric ammonium ethylenediaminetetraacetate dihydrate | 60 g |
| Ethylenediaminetetraacetic acid | 3 g |
| Ammonium thiosulfate (an aqueous 70% solution) | 100 ml |
| Ammonium sulfite (an aqueous 40% solution) | 27.5 ml |
| Made up to 1 liter by adding water and adjusted to pH = 6.2 using potassium carbonate or glacial acetic acid. | |
| [Stabilizing solution] | |
| 5-Chloro-2-methyl-4-isothiazolin-3-on | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (an aqueous 20% solution) | 3.0 g |
| Ammonium sulfite | 3.0 g |
| Brightening agent (a 4,4'-diaminostilbene disulfonic acid derivative) | 1.5 g |
| Made up to 1 liter by adding water and adjusted to pH = 7.0 using sulfuric acid or potassium hydroxide. | |

On the samples thus obtained, red-light reflection density was measured using a PDA-65 densitometer (available from Konica Corporation) to find the following characteristic values.

Speed:

Expressed by a reciprocal of the amount of exposure necessary for obtaining a density of 0.8, and corresponds to a relative speed observed when the speed of Sample 1 is assumed as 100.

Gradient:

The value of a tangent of the slope connecting points 0.25 and 0.75 of the characteristic curve Fog:

The density produced when an unexposed sample is developed for 100 seconds using the above color developing solution.

To observe the rapid processing suitability, also obtained was maximum density produced when the above color developing time was varied to 50 seconds and 100 seconds.

Further, unexposed samples (raw samples) were left for 1 month under the conditions of 25° C. and a relative humidity of 60%, and thereafter the same exposure and development processing as in the above were carried out to evaluate the storage stability of the raw samples, according to the equation shown below.

Change in fog caused by storage (ΔFOG)
= (fog after storage) − (fog before storage)
Change in speed caused by storage (%)
= (speed after storage/speed before storage × 100
Results obtained are shown together in Table 2.

TABLE 2

| | Fog | Speed | Gradient | Dmax 50 sec. | Dmax 100 sec. | During storage Change in fog | During storage Change in speed |
|---|---|---|---|---|---|---|---|
| 1 (X) | 0.12 | 100 | 2.21 | 0.87 | 1.38 | 0.05 | 91% |
| 2 (X) | 0.14 | 82 | 1.53 | 0.71 | 1.15 | 0.04 | 75 |
| 3 (X) | 0.19 | 42 | 1.14 | 1.04 | 1.03 | 0.13 | 85 |
| 4 (X) | 0.24 | 98 | 1.86 | 2.05 | 2.04 | 0.18 | 82 |
| 5 (Y) | 0.14 | 102 | 2.18 | 2.08 | 2.05 | 0.04 | 95 |
| 6 (Y) | 0.13 | 175 | 2.22 | 2.04 | 2.04 | 0.05 | 94 |
| 7 (Y) | 0.13 | 108 | 2.21 | 2.05 | 2.07 | 0.01 | 95 |
| 8 (Y) | 0.14 | 182 | 2.19 | 2.09 | 2.07 | 0.03 | 93 |
| 9 (Y) | 0.12 | 106 | 2.20 | 2.08 | 2.06 | 0.03 | 93 |
| 10 (Y) | 0.12 | 178 | 2.23 | 2.04 | 2.02 | 0.04 | 94 |

(X): Comparative Example
(Y): Present Invention

Results in Table 2 tell that Samples 1 and 2 comprising silver chlorobromide (silver chloride: 50 mol %) are not suited for rapid processing. In Sample 2, the lowering of film pH has caused desensitization and resulted in soft gradation.

On the other hand, Samples 3 to 10 employing the silver chloride-rich emulsion have already reached the maximum density after development for 50 seconds, and are seen to be superior in the rapid processing suitability. However, Sample 3 show a low speed and a high fog, and moreover a great change in fog during storage. Higher speed can be achieved in Sample 4 subjected to gold sensitization, but fog becomes still higher, resulting in remarkable soft gradation at the toe and deterioration of storage stability.

In contrast with the above, in Samples 5 to 10 attributing the combination according to the present invention, fog and storage stability have been improved without deterioration of speed and gradation. This effect can not be expected from what has been conventionally known. Combined used of sulfur sensitization also makes it possible to achieve still higher speed without increase in fog. (see Samples 6, 8 and 10).

EXAMPLE 2

Samples 11 to 20 were prepared following the same procedures as for Sample 1 except that the cyan couplers CC-1+CC-2, the magenta coupler MC-1 and the yellow coupler YC-1 used in Example 1 were replaced with CC-1+CC-3, MC-2 and YC-2, respectively, the high boiling solvent DOP was replaced with TCP, and the silver halide emulsions and hardening agents were varied as shown in Table 3.

CC-3

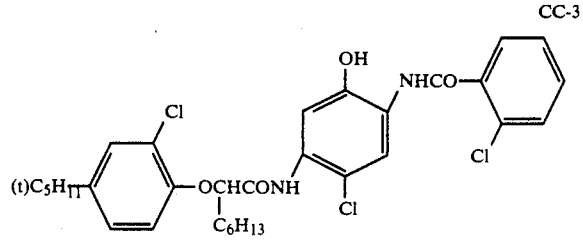

-continued

MC-2

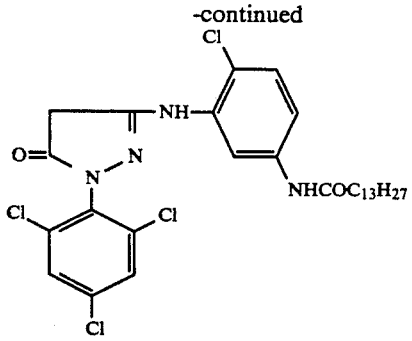

YC-2

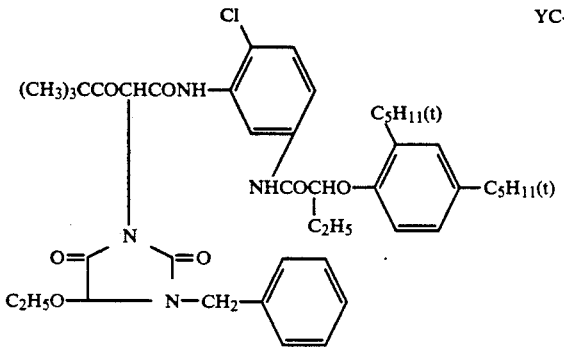

TCP: Tricresyl phosphate

Each sample was processed in the same manner as in Example 1 to measure the fog, speed, gradient, and changes in fog and speed during storage. Results obtained are shown in Table 3.

TABLE 1

| Sample No. | Em No. | Amount (mol/molAgX) Chloro-auric acid | Sodium thio-sulfate | Film pH | Hardening agent | Photographic characteristics Fog | Speed | Gra-dient | Storage stability Change in fog | Change in speed |
|---|---|---|---|---|---|---|---|---|---|---|
| 11 (X) | EM-2 | $2.7 \times 10^{-6}$ | — | 6.3 | HDC | 0.21 | 99 | 1.74 | 0.15 | 84% |
| 12 (X) | " | — | — | 5.7 | HD-2 | 0.17 | 45 | 1.10 | 0.08 | 80 |
| 13 (Y) | " | $2.7 \times 10^{-6}$ | — | 5.7 | " | 0.11 | 103 | 2.24 | 0.05 | 92 |
| 14 (Y) | " | " | — | 5.5 | HD-11 | 0.10 | 108 | 2.26 | 0.06 | 95 |
| 15 (Y) | " | " | $3.5 \times 10^{-6}$ | 5.7 | HD-2 | 0.12 | 177 | 2.28 | 0.05 | 93 |
| 16 (Y) | EM-3 | " | — | 5.7 | " | 0.11 | 107 | 2.27 | 0.04 | 92 |
| 17 (Y) | " | " | $3.5 \times 10^{-6}$ | 5.7 | " | 0.13 | 182 | 2.23 | 0.05 | 95 |
| 18 (Y) | " | " | $3.5 \times 10^{-6}$ | 5.5 | HD-11 | 0.12 | 188 | 2.24 | 0.05 | 94 |
| 19 (Y) | EM-4 | " | — | 5.7 | HD-2 | 0.10 | 105 | 2.22 | 0.06 | 94 |
| 20 (Y) | " | " | $3.5 \times 10^{-6}$ | 5.7 | " | 0.10 | 192 | 2.24 | 0.05 | 94 |

(X): Comparative Example
(Y): Present Invention

As will be clear from Table 3 also, only the combination according to the present invention has brought about good photographic performances and improved storage stability. It is also seen that the combined use of sulfur sensitization makes it possible to achieve still higher speed even in silver chloride-rich silver halide emulsions.

The light-sensitive silver halide photographic materials attributing the combination according to the present invention have a high speed, a high gradient and a low fog, and remarkably improve the lowering of speed and increase in fog even after storage over a long period of time. They also have superior rapid processing suitability.

What is claimed is:

1. A light-sensitive silver halide photographic material comprising a support and provided thereon photographic component layers including at least one light-sensitive silver halide emulsion layer containing sillver halide grains having a silver chloride content of not less than 90 mole % and having been subjected to gold sensitization, said photographic component layer containing a gelatin of which isoelectric point being 4.0 to 5.0 and the film pH of said photographic component layer being not more than 6.0.

2. The light-sensitive silver halide photographic material of claim 1, wherein said silver halide contains not more than 10 mole % of silver bromide and not more than 0.5 mole % of silver iodide.

3. The light-sensitive silver halide photographic material of claim 1, wherein said silver halide is a silver chlorobromide containing 0.1 to 2 mole % of silver bromide.

4. The light-sensitive silver halide photographic material of claim 1, wherein said silver halide grains are present at a proportion of not less than 60% by weight with respect to the total silver halide grains present in said silver halide emulsion layer.

5. The light-sensitive silver halide photographic material of claim 4, wherein the proportion is not less than 80% by weight.

6. The light-sensitive silver halide photographic material of claim 1, wherein said light-sensitive silver halide emulsion layer has been sensitized by the use of a chalcogen sensitizer.

7. The light-sensitive silver halide photographic material of claim 6, wherein said chalcogen sensitizer is selected from a sulfur sensitizer and a selenium sensitizer.

8. The light-sensitive silver halide photographic material of claim 1, wherein said gold sensitizer is used in an amount of $10^{-8}$ mole to $10^{-1}$ mole per 1 mole of silver halide.

9. The light-sensitive silver halide photographic material of claim 8, wherein said gold sensitizer is used in an amount of $10^{-7}$ mole to $10^{-2}$ mole per 1 mole of silver halide.

10. The light-sensitive silver halide photographic material of claim 7, wherein said chalcogen sensitizer is a sulfur sensitizer.

11. The light-sensitive silver halide photographic material of claim 10, wherein said sulfur sensitizer is used in an amount of $10^{-7}$ mole to $10^{-1}$ mole per 1 mole of silver halide.

12. The light-sensitive silver halide photographic material of claim 1, wherein said light-sensitive silver halide emulsion layer has been hardened by the use of a chlorotriazine gelatine hardener.

13. The light-sensitive silver halide photographic material of claim 12, wherein said chlorotriazine compound is represented by the general formula [HDA] or [HDB];

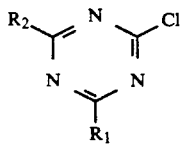

[HDA]

wherein $R_1$ and $R_2$ independently represent a chlorine atom, a hydroxyl group, an alkyl group, an alkoxy group, an —OM group, in which M is a mono-valent metal atom, a $—NR_3R_4$ group in which $R_3$ and $R_4$ independently represent a hydrogen atom, an alkyl group, or an aryl group, or a $—NHCOR_5$ group, in which $R_5$ is a hydrogen atom, an alkyl group, an aryl group or an alkylthio group, provided that $R_1$ and $R_2$ are not simultaneously chlorine atoms; and

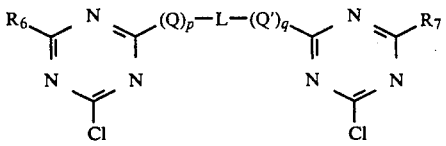

[HDB]

wherein $R_6$ and $R_7$ independently represent a chlorine atom, a hydroxyl group, an alkyl group, an alkoxy group, or an —OM group, in which M is a mono-valent metal atom, Q and Q' independently represent a linkage group selected from —O—, —S— and —NH—, L represents an alkylene group or an arylene group, and p and q are independently 0 or 1.

* * * * *